US009821351B2

(12) United States Patent
Hammers

(10) Patent No.: US 9,821,351 B2
(45) Date of Patent: Nov. 21, 2017

(54) WELDING FUME EXTRACTOR

(75) Inventor: Brian J. Hammers, Fremont, WI (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 873 days.

(21) Appl. No.: 13/610,490

(22) Filed: Sep. 11, 2012

(65) Prior Publication Data

US 2013/0122795 A1 May 16, 2013

Related U.S. Application Data

(60) Provisional application No. 61/558,856, filed on Nov. 11, 2011.

(51) Int. Cl.

| | |
|---|---|
| ***B05C 15/00*** | (2006.01) |
| ***B08B 15/02*** | (2006.01) |
| ***B07B 7/086*** | (2006.01) |

(52) U.S. Cl.

CPC ..... *B08B 15/02* (2013.01); *B07B 7/086* (2013.01)

(58) Field of Classification Search

USPC ..... 454/49–67; 95/267–268, 272; 55/434

See application file for complete search history.

(56) References Cited

U.S. PATENT DOCUMENTS

| | | | |
|---|---|---|---|
| 2,185,919 | A | 1/1940 | Kurth |
| 2,210,458 | A | 8/1940 | Keilholtz |
| 2,289,474 | A | 7/1942 | Anderson |
| 2,367,104 | A | 1/1945 | Demuth |
| RE24,637 | E | 4/1959 | Wulle |
| 2,910,558 | A | 10/1959 | Engelhardt |
| 3,318,227 | A | 5/1967 | Nelson et al. |

(Continued)

FOREIGN PATENT DOCUMENTS

| | | |
|---|---|---|
| AU | 637737 | 6/1993 |
| CH | 682512 | 9/1993 |

(Continued)

OTHER PUBLICATIONS

International Search Report from PCT application No. PCT/US2014/036956, dated Aug. 29, 2014, 14 pgs.

(Continued)

*Primary Examiner* — Avinash Savani
*Assistant Examiner* — Vivek Shirsat
(74) *Attorney, Agent, or Firm* — Fletcher Yoder P.C.

(57) ABSTRACT

A fume extraction hood is designed to be positioned above a welding, cutting, or other metal-working location and to remove hot gases, smoke and fumes produced during these processes. The hood forms a box-like structure with an extractor rail structure disposed in an internal volume of the hood. The extractor rail structure comprises panels that force sharp turns in the gases, causing particulate matter to drop out of the gases both outside and inside the extractor rail. A primary path for gases accelerates and re-directs the gases entering into the extractor rail, and within the rail. The rail may form a dropout tray that can be removed for cleanout of collected particulate. The side and end rails of the hood may create a secondary path for gas not directly intaken into the extractor rail. This secondary path is re-directed towards the extractor rail, where gas is collected and particulate is forced to drop out as it joins the primary path.

13 Claims, 5 Drawing Sheets

(56) References Cited

U.S. PATENT DOCUMENTS

| | | | | |
|---|---|---|---|---|
| 3,364,664 | A * | 1/1968 | Doane | F24C 15/20 126/299 D |
| 3,430,551 | A | 3/1969 | Hauville | |
| 3,487,767 | A | 1/1970 | Kristiansen | |
| 4,016,398 | A | 4/1977 | Herrick | |
| 4,033,846 | A | 7/1977 | Engesland | |
| 4,043,257 | A | 8/1977 | Aaberg | |
| 4,158,462 | A | 6/1979 | Coral | |
| 4,160,407 | A | 7/1979 | Duym | |
| 4,163,650 | A | 8/1979 | Watson | |
| RE31,266 | E | 6/1983 | Engesland | |
| 4,450,756 | A | 5/1984 | Kling | |
| 4,493,970 | A | 1/1985 | Rieppel | |
| 4,502,375 | A | 3/1985 | Hignite | |
| 4,552,059 | A | 11/1985 | Potter | |
| 4,607,614 | A | 8/1986 | Higashino et al. | |
| 4,717,805 | A | 1/1988 | Miyagawa | |
| 4,823,971 | A * | 4/1989 | Her | F24C 15/20 220/4.01 |
| 4,905,716 | A | 3/1990 | Hubbard | |
| 5,058,490 | A | 10/1991 | Sodec | |
| 5,069,197 | A | 12/1991 | Wisting | |
| 5,223,005 | A | 6/1993 | Avondoglio | |
| 5,263,897 | A | 11/1993 | Kondo | |
| 5,281,246 | A | 1/1994 | Ray | |
| 5,395,410 | A | 3/1995 | Jang | |
| 5,410,120 | A | 4/1995 | Taylor | |
| 5,427,569 | A | 6/1995 | Plymoth | |
| 5,540,214 | A * | 7/1996 | Boudreault | 126/299 E |
| 5,713,346 | A | 2/1998 | Kuechler | |
| 5,718,219 | A * | 2/1998 | Boudreault | 126/299 E |
| 5,890,484 | A | 4/1999 | Yamada | |
| 5,904,751 | A * | 5/1999 | Van Niekerk | B01D 46/30 55/385.1 |
| 6,037,725 | A | 3/2000 | Tolbert, Jr. | |
| 6,099,607 | A | 8/2000 | Haslebacher | |
| 6,332,837 | B1 | 12/2001 | Wilk | |
| 6,358,137 | B1 | 3/2002 | Threlfall | |
| 6,569,008 | B1 | 5/2003 | Chang | |
| 6,607,573 | B1 | 8/2003 | Chaurushia | |
| 6,616,720 | B1 | 9/2003 | Smith | |
| 6,620,038 | B1 | 9/2003 | Kikuchi | |
| 6,632,132 | B1 | 10/2003 | Kikuchi | |
| 6,780,213 | B2 | 8/2004 | Chang | |
| 6,913,014 | B2 | 7/2005 | Chiang | |
| 7,000,634 | B2 | 2/2006 | Lindborg | |
| 7,959,696 | B2 | 6/2011 | Martic | |
| 8,176,766 | B1 | 5/2012 | Ruiz | |
| 8,211,194 | B2 | 7/2012 | Takayanagi | |
| 8,312,873 | B2 | 11/2012 | Gagas | |
| 8,460,417 | B2 | 6/2013 | Reid | |
| 8,892,222 | B2 | 11/2014 | Simms | |
| 2002/0039881 | A1 | 4/2002 | Coral | |
| 2003/0181158 | A1 | 9/2003 | Schell | |
| 2005/0170767 | A1 | 8/2005 | Enzenroth | |
| 2005/0204582 | A1 | 9/2005 | Rossi | |
| 2006/0157048 | A1 | 7/2006 | Heilman | |
| 2007/0202791 | A1 | 8/2007 | Lee | |
| 2007/0281598 | A1 | 12/2007 | Huang | |
| 2008/0305731 | A1 | 12/2008 | Reid | |
| 2009/0088060 | A1 | 4/2009 | Arnold | |
| 2009/0321403 | A1 | 12/2009 | Brenneke | |
| 2010/0206799 | A1 | 8/2010 | Leavitt | |
| 2010/0282728 | A1 | 11/2010 | Cole | |
| 2012/0111845 | A1 | 5/2012 | Simms | |
| 2012/0193334 | A1 | 8/2012 | Mehn | |
| 2013/0162177 | A1 | 6/2013 | Hofsdal | |

FOREIGN PATENT DOCUMENTS

| | | |
|---|---|---|
| CN | 2146665 | 11/1993 |
| CN | 2225253 | 4/1996 |
| CN | 2413708 | 1/2001 |
| CN | 1384909 | 12/2002 |
| CN | 200984583 | 12/2007 |
| CN | 101327109 | 12/2008 |
| CN | 101332392 | 12/2008 |
| CN | 101526239 | 9/2009 |
| CN | 201609707 | 10/2010 |
| CN | 202087569 | 12/2011 |
| CN | 102483240 | 5/2012 |
| CN | 102699002 | 10/2012 |
| DE | 1604293 | 9/1970 |
| DE | 3412204 | 10/1985 |
| DE | 4413600 | 11/1995 |
| DE | 10020736 | 10/2001 |
| DE | 20221100 | 1/2005 |
| DE | 102005016721 | 10/2006 |
| DE | 102005033224 | 7/2007 |
| DE | 102006055001 | 5/2008 |
| DE | 102009030220 | 12/2010 |
| EP | 0511576 | 11/1992 |
| EP | 0536871 | 4/1993 |
| EP | 1227283 | 7/2002 |
| EP | 1967796 | 9/2008 |
| EP | 2368646 | 9/2011 |
| EP | 2422865 | 2/2012 |
| FR | 2613551 | 10/1988 |
| FR | 2911520 | 7/2008 |
| GB | 546878 | 8/1942 |
| GB | 1069868 A | 5/1967 |
| GB | 2030825 | 5/1980 |
| GB | 2032825 A | 5/1980 |
| JP | S54147647 | 11/1979 |
| JP | H01179841 | 7/1989 |
| JP | H04063183 | 2/1992 |
| JP | H06292970 | 10/1994 |
| JP | H10288371 | 10/1998 |
| WO | 0048752 A1 | 8/2000 |
| WO | 0184054 | 11/2001 |
| WO | 2004088812 | 10/2004 |
| WO | 2005022046 | 3/2005 |
| WO | 2005045323 | 5/2005 |
| WO | 2005106337 | 11/2005 |
| WO | 2008032571 | 3/2008 |

OTHER PUBLICATIONS

International Search Report from PCT application No. PCT/US2014/044119, dated Sep. 10, 2014, 10 pgs.
International Search Report from PCT application No. PCT/US2012/064081 dated Feb. 14, 2013, 12 pgs.
International Search Report from PCT application No. PCT/US2014/011860, dated Apr. 24, 2015, 10 pgs.
International Search Report & Written Opinion of PCT/US2012/022599 dated May 2, 2012.
International Search Report from PCT application No. PCT/US2013/031237 dated Jul. 23, 2013, 11 pgs.
International Search Report from PCT application No. PCT/US2013/031261 dated Jul. 25, 2013, 13 pgs.
International Search Report from PCT application No. PCT/US2013/030694 dated Aug. 20, 2013, 15 pgs.
International Search Report from PCT application No. PCT/US2013/031246 dated Aug. 9, 2013, 13 pgs.
International Search Report from PCT application No. PCT/US2013/031251 dated Aug. 6, 2013, 15 pgs.
International Search Report from PCT application No. PCT/US2013/030697 dated Jul. 30, 2013, 13 pgs.

* cited by examiner

WELDING FUME EXTRACTOR

CROSS-REFERENCE TO RELATED APPLICATIONS

This application is a Non-Provisional Patent Application of U.S. Provisional patent application Ser. No. 61/558,856, entitled "Welding Fume Extractor", filed on Nov. 11, 2011, which is herein incorporated by reference.

BACKGROUND

The present invention relates generally to welding and other metal-working systems, and particularly to evacuation hoods used in such systems for extracting hot gases, smoke and fumes created during the processes.

Many welding processes, and similar metal-working operations, have become commonplace throughout industry. In both manual and automated applications, welding often takes place in dedicated locations, sometimes referred to as weld cells, which may include individual welding systems, or more complete production lines for creating various assemblies of workpieces. Most such welding involves metal inert gas (MIG) processes, although other processes including stick welding, tungsten inert gas (TIG) welding, plasma cutting, grinding, and so forth may take place in the dedicated locations.

In many such settings it is desirable to extract hot gases, smoke and fumes created during the processes, at least, while the process is ongoing. Various hoods, extraction systems, and similar devices have been devised for this purpose. In general, such systems often include a hood or other intake coupled to a conduit that draws the gases, smoke and fumes from the worksite to various filters, blowers, air recirculation and exhaust components. Certain drawbacks are often associated with existing evacuation systems, however. For example, the systems may not accommodate different sizes and configurations of weld cells or welding locations. Moreover, while some screening and filtration may be provided, certain existing systems may allow for the intake of particulate matter and even sparks from the process. It would be advantageous to allow such a particulate matter to be eliminated from the gases extracted from the work location, although existing systems do little to advance this goal.

There is a need, therefore, for improved extraction systems for welding and similar metal working applications.

BRIEF DESCRIPTION

The present invention provides novel approaches to fume and smoke extraction designed to respond to such needs. The systems are particularly adapted for welding, cutting, and similar metal-working operations that can generate fumes, smoke, hot gases, but also particulate matter and sparks. However, the embodiments described herein may be equally beneficial in any processes that generate fumes, particulate matter, and so forth, during operation. In accordance with certain aspects of the invention, a fume extractor hood includes a box-like structure and an extractor rail structure. The box-like structure has end rails, side rails and a cover, and is configured to at least partially enclose a volume over a welding, cutting or other metal-working process (or any other process, for that matter) that generates fumes and particulate matter during operation. The extractor rail structure is disposed in the volume and configured to draw fumes and particulate towards an inner space from which the fumes are conveyed to exhaust ductwork. The extractor rail comprises a side wall that forces a sharp turn in all fumes drawn into the extractor rail to force dropout of at least some of the particulate matter. An inner passageway between the side wall and a deflector accelerates the fumes entering the extractor rail. Gas entries force a second sharp turn in all fumes drawn into the extractor rail to force dropout of particulate matter entrained with the fumes into the inner passageway.

In accordance with cetain aspects, the invention offers a fume extractor hood that comprises, as before, and an extractor rail structure disposed in the volume and configured to draw fumes and particulate towards an inner space from which the fumes are conveyed to exhaust ductwork. The extractor rail comprises generally parallel panels that force at least one sharp turn in all fumes drawn into the extractor rail to force dropout of at least some of the particulate matter outside the extractor rail. At least one gas entry forces at least one second sharp turn in all fumes drawn into the extractor rail to force dropout of particulate matter entrained with the fumes to a collection location within the extractor rail.

In accordance with a further aspect, the invention provides a fume extractor hood that again includes a box-like structure having end rails, side rails and a cover, the box-like structure configured to at least partially enclose a volume over a welding, cutting or other metal-working process that generates fumes and particulate matter during operation, and an extractor rail structure disposed in the volume and configured to draw fumes and particulate towards an inner space from which the fumes are conveyed to exhaust ductwork. The extractor rail comprises walls defining a primary fume path, the side walls being configured and disposed to force a plurality of sharp turns in all fumes drawn into the extractor rail to force dropout of at least some of the particulate matter outside and inside the extractor rail. At least one of the side and end rails comprises a re-directing shape that re-directs fumes in a secondary fume path for fumes not directly entering the extractor rail downwardly and back towards the extractor rail.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
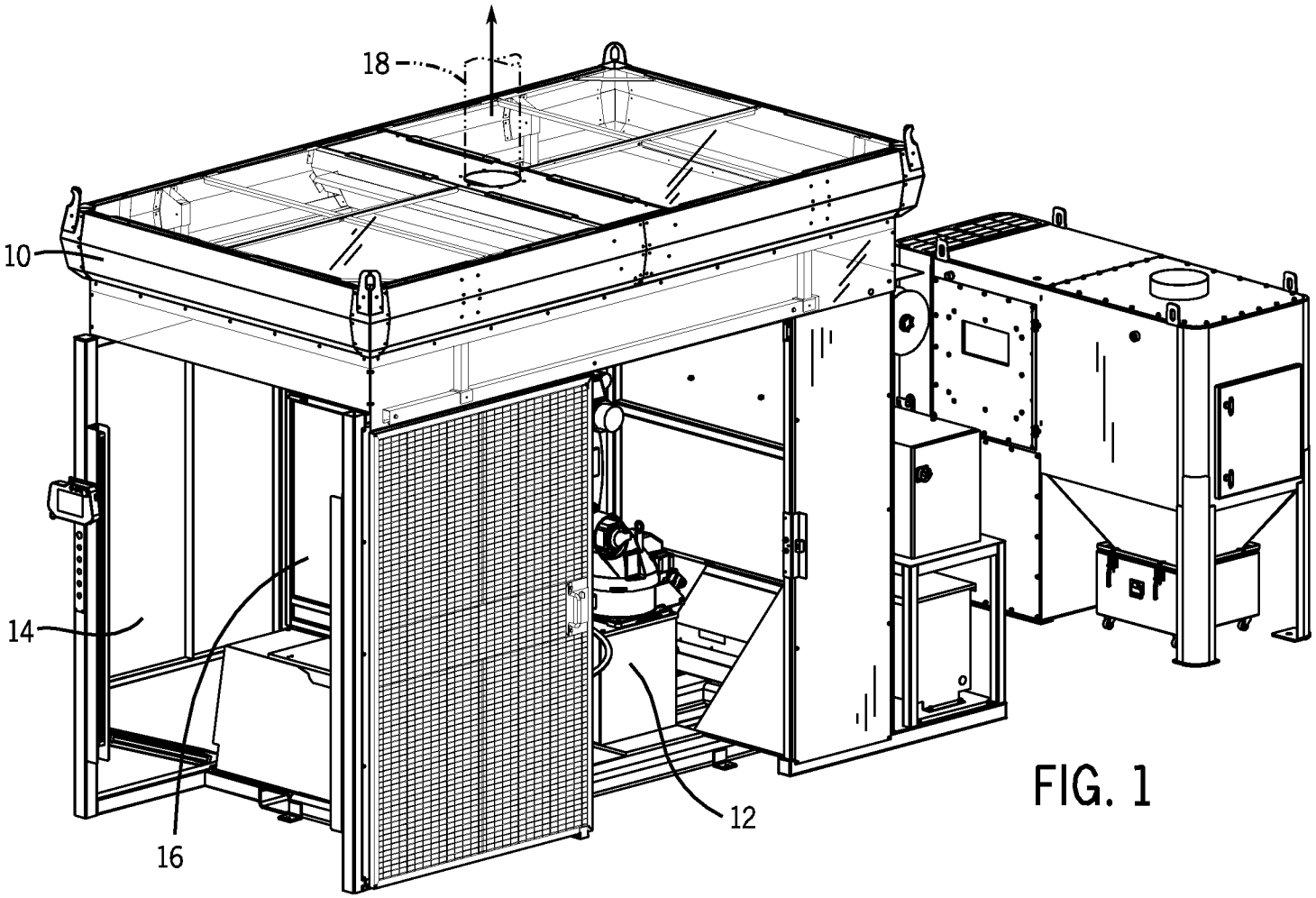
FIG. 1 is a perspective view of an exemplary welding location, in this case comprising a weld cell, with a hood associated with a weld cell for extraction of gases, smoke and fumes in accordance with aspects of the present disclosure.

Turning now to the drawings, and referring first to FIG. 1, an evacuation hood 10 is illustrated above a welding system 12. In the illustrated embodiment, the welding system is disposed in a weld cell 14 defined by a support structure with panels that least partially surround the welding system. In other installations, the evacuation hood 10 may be provided above welding systems, cutting systems, or other metal-working equipment without surrounding walls, curtains, or the like. However, in many applications it will be useful to provide such isolation from surrounding environments. Moreover, the structure of the weld cell allows for at least partial containment of smoke and fumes created during the metal-working operation.

It should be noted that while described herein as being used in conjunction with a welding system, in other embodiments, the evacuation hood 10 may be used with cutting systems, other metal-working equipment, or any other equipment that generates fumes and/or particulate matter during operation. As described herein, the terms "particulate" and "particular matter" are intended to cover any and all of the relatively small particles that tend to travel with the gases, smoke, and fumes that are generated by the processes, such as weld sparks, soot, dust, sawdust, and so forth.

The illustrated weld cell 14 generally encloses an internal volume 16 in which the welding operations are performed. In the illustrated embodiment, again, the operations are performed by a robot in an automated fashion. Such production facilities may include one or more robots, and these may be provided in individual weld cells, or in larger production areas around individual or progressing workpieces or assemblies. However, it should be borne in mind that the evacuation hood and the techniques described in the present disclosure may be equally well applied to manual welding applications, and operations in which a combination of automated and manual work takes place, and so forth.

The hood 10 illustrated in FIG. 1 is coupled to conduit or ductwork 18 that aids in evacuation of gases, smoke, and fumes. The ductwork and any downstream components may be essentially the same as those used in conventional systems, allowing for application of suction pressures to pull gases, smoke and fumes from around the welding operation, through screening and filtration components, blowers, and air recirculation and exhaust components.

Figure 2:
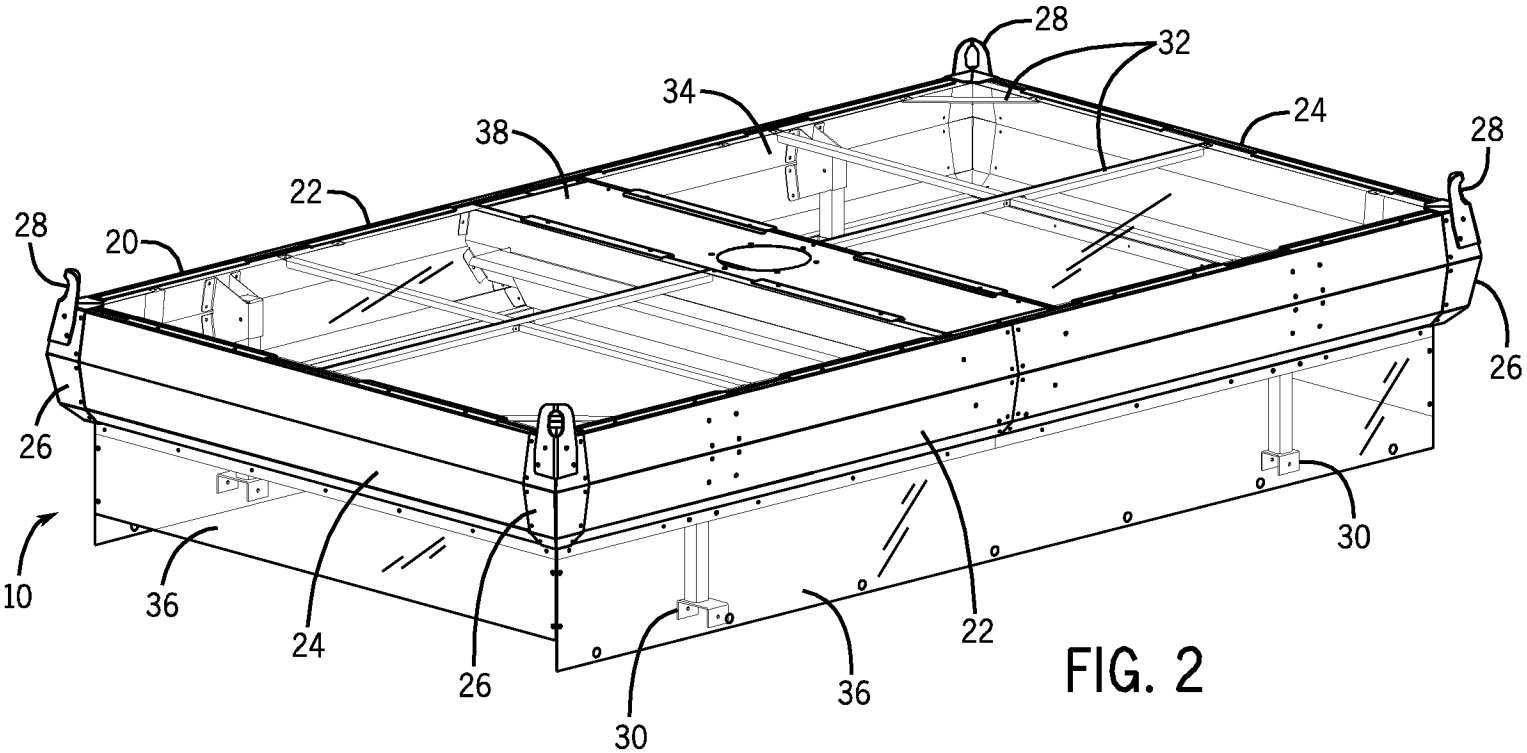
FIG. 2 is a perspective view of the hood illustrated in FIG. 1 as showing certain of the structural components of the hood.

The evacuation hood 10 is illustrated in somewhat greater detail in FIG. 2. As shown in FIG. 2, the hood includes a box-like structure made of a frame 20 which may consist of side rails 22 and end rails 24. In the rectangular arrangement of FIG. 2, the side rails and end rails are essentially identical in section, and may be formed of bent sheet metal or another construction material. Corner joints 26 allow these rails to be joined to one another to form to form the box-like hood. Although not illustrated, straight coupling joints similar to the corner joints may also be used to join rails end-to-end so as to allow creation of hoods of various sizes and shapes. The corner joints 26 in the illustrated embodiment are provided with lifting eyes 28 to allow cranes, hoists, or other equipment to position the hood in the desired location. Similarly, supports 30 may be coupled to the hood, and extend downwardly so as to allow the hood to be rested on underlying support structures, such as the frame of a weld cell. However, it should borne in mind that the hood may be suspended, supported, or otherwise held in place in any suitable manner.

Between the side and end rails, various braces and struts 32 may be provided to lend structural rigidity to the hood and support for a cover 34 that aids in enclosing the volume immediately below the hood. In the illustrated embodiment the cover 34 is made of a clear polycarbonate material to allow light to penetrate into the work location, while nevertheless capturing gases, fumes, and smoke. The braces and struts 32 aid in supporting the cover 34, and may be fastened to the cover, such as by clips or other fasteners. In the illustrated embodiment, moreover, side curtains 36 are provided to assist for isolating the internal volume of the hood. These curtains may be short as illustrated in the figures, or may extend downwardly even further to isolate and contain the internal volume.

Within this internal volume of the hood, and extractor rail 38 is provided. In the embodiment illustration throughout the figures, the extractor rail is disposed in central location transverse to the side rails. The extractor rail comprises structures that aid in the capturing of gases, smoke and fumes, while assisting in rejecting particulate matter, sparks, and the like. An aperture is formed in the cover that communicates with the internal volume of the extractor rail to allow gases to be conveyed to the ductwork as described above with reference to FIG. 1. Although a single extractor rail 38 is illustrated in the figures, in practice, numerous extractor rails may be provided, such as for longer or extended hoods. These may be oriented transversely as illustrated in the figures, or longitudinally. Moreover, in many applications it may be warranted to place additional extractor rails over specific locations where welding, cutting, or other metal-working activities will take place.

Figure 3:
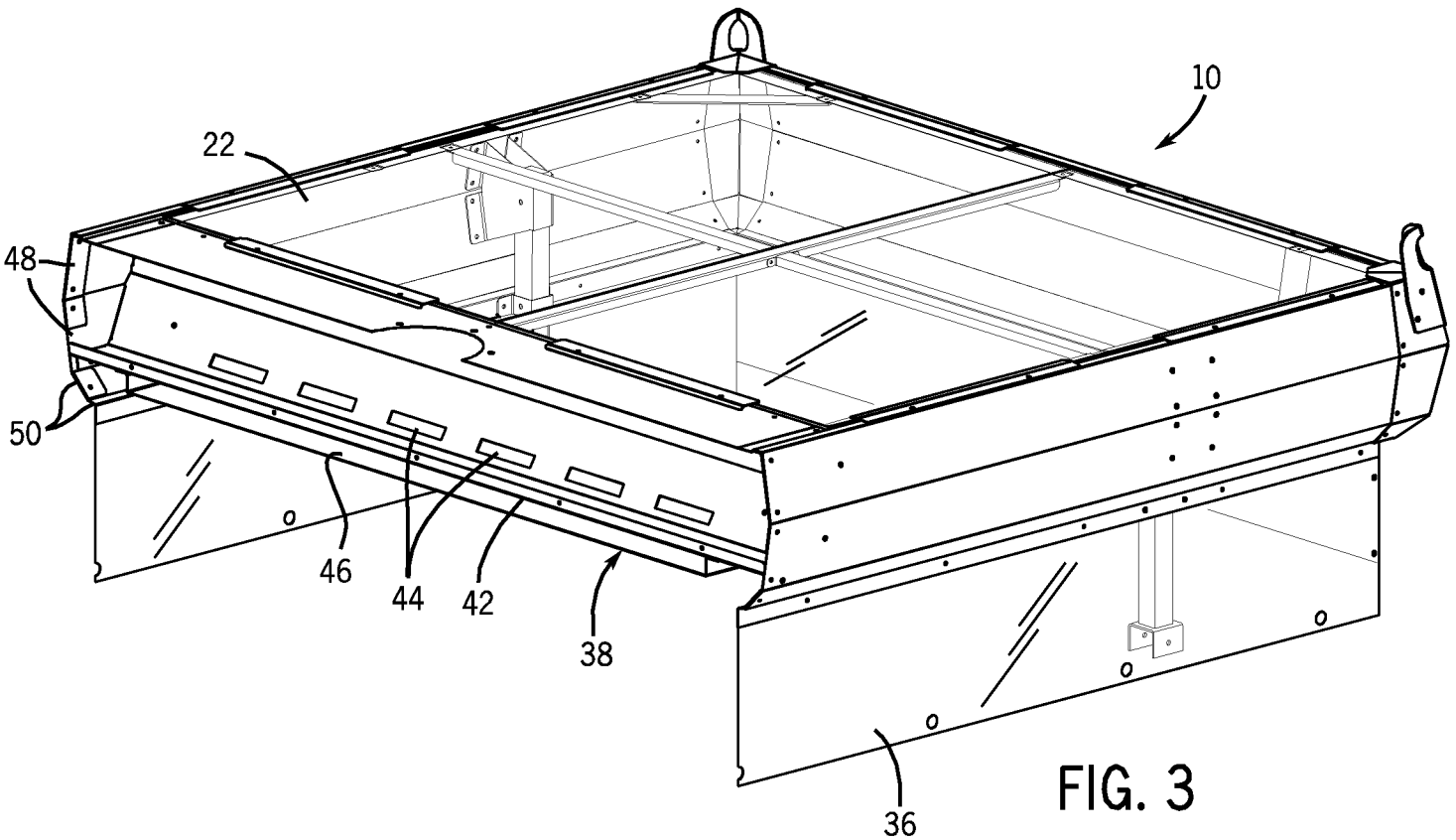
FIG. 3 is a transverse sectional view of the hood of FIG. 2, illustrating internal structures of an extractor rail that draws smoke and fumes from within the hood, while eliminating particulate matter.
Figure 4:
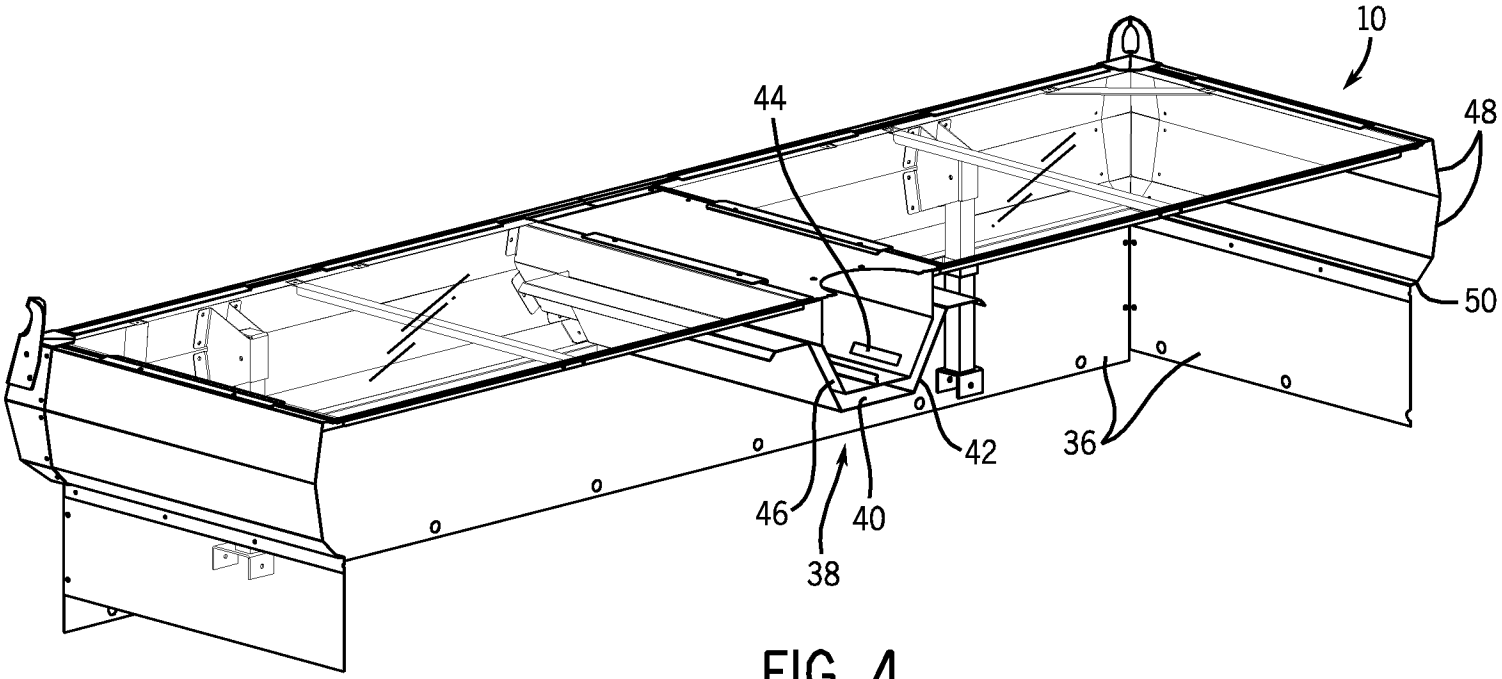
FIG. 4 is a longitudinal section of the same hood, showing the internal components of the extractor rail.

FIGS. 3 and 4 are transverse and longitudinal sections of the hood shown in FIG. 2, illustrating in somewhat greater detail the internal components of the side and end rails and the extractor rail. Referring to these sectional views, the extractor rail 38 comprises a dropout tray 40 at least partially surrounding a deflector structure 42. As described more fully below, the dropout tray and deflector structure cooperate to allow channeling of hot gases, smoke and fumes into the extractor rail, while assisting in rejecting particulate matter. Slots 44 are formed in the deflector structure in the illustrated embodiment, and these allow for passage of the gases from internal gas passageways 46 between the dropout tray and the deflector structure into the internal volume of the extractor rail, and therefrom to the associated ductwork.

The side and end rails in the illustrated embodiment comprise curved or facetted portions that assist in channeling gases toward the extractor rail. That is, as best illustrated in FIG. 4, side panels 48 extend from the cover of the hood downwardly, and join one or more lower re-directing panels 50 that deflect gases that are not directly in taken by the extractor rail back towards the extractor rail.

Figure 5:
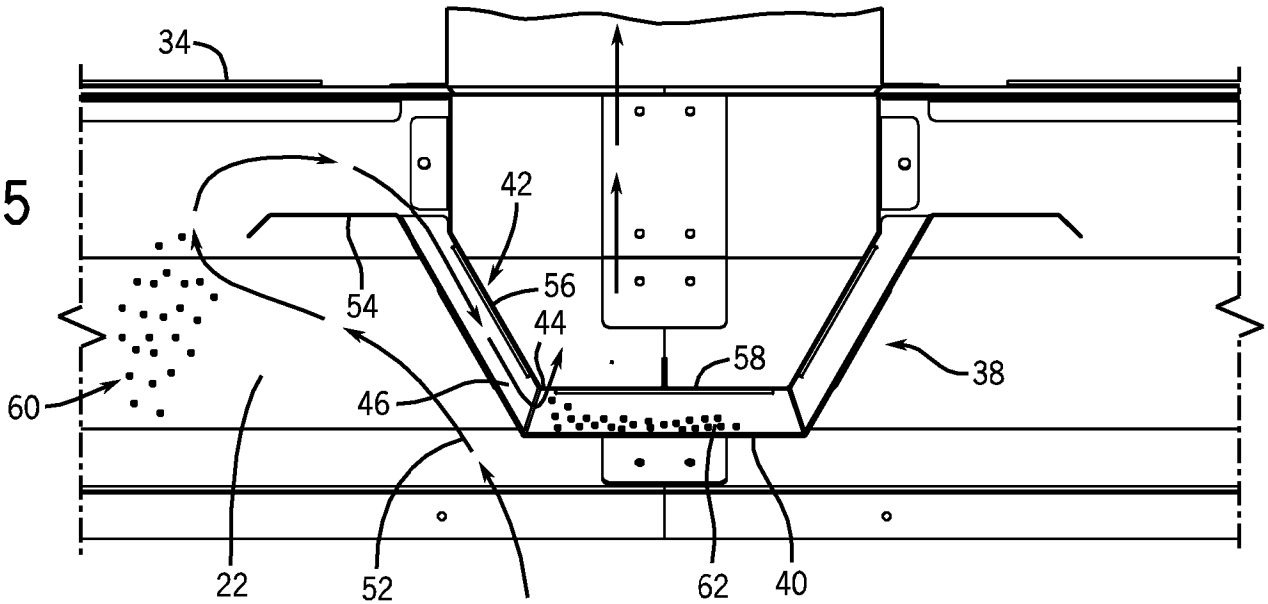
FIG. 5 is a sectional view through the exemplary extractor rail, illustrating a primary path for the flow of gases through the structure, and rejection of particulate matter.

FIG. 5 is a sectional view of the exemplary extractor rail described above illustrating a primary path 52 for gases, smoke and fumes. Such gases will rise upwardly towards the extractor rail owing to their thermal buoyancy (and the negative pressure created by evacuation of air below the hood), and will be drawn into the extractor rail as illustrated in FIG. 5. It is presently contemplated that most of the gases will be drawn in through this primary path. The primary path extends upwardly and around lateral extensions 54 where the path makes a sharp turn inwardly toward the center line of the extractor rail. Much or most of the particulate matter that may be entrained in the rising gases will fall out at this point due to this sharp turn, as indicated by reference numeral 60. The primary path then extends between a deflector plate 56 of the deflector structure 42 and the lower side of the dropout tray. The gases are accelerated due to a reduced cross-sectional area at this location, and may enter the slots 44 with another sharp turn. The slots 44 are formed between the deflector plate 56 and a base plate 58 of the deflector structure near a lower portion of the deflector plate. In a presently contemplated embodiment, for example, with a gas flow velocity within the hood for good gas capture on the order of at least approximately 45 ft/min, the velocity of the gas in the internal passageway between the side wall of the dropout tray and the deflector plate may be on the order of at least approximately 200 ft/min. The second sharp turn, then, causes the gases to further accelerate angularly, but also, in a presently contemplated embodiment, in speed owing to the dimensions of the slots. For example, in the example discussed above, velocities on the order of at least approximately 3600 ft/min may be reached as the gases pass through the slots. Other velocities may, of course be used, and these may depend upon the capacity of the air-moving components, the ductwork, the volume of gas produced, and so forth. Much of any remaining particulate matter remaining in the gases will dropout at this point, as indicated by reference numeral 62. The particulate matter 62 will collect below the base plate, and may be cleaned out from time to time. The dropout tray may be made removable for this purpose. Although only one side of the primary path is illustrated in FIG. 5, it would be understood that the same flow and particulate rejection occurs on opposite side, the extractor rail in the illustrated embodiment being generally bilaterally symmetrical. Moreover, the slots 44 are disposed along the length of the extractor rail, such that similar gas draw and particulate rejection occurs along the entire length of the rail.

Figure 6:
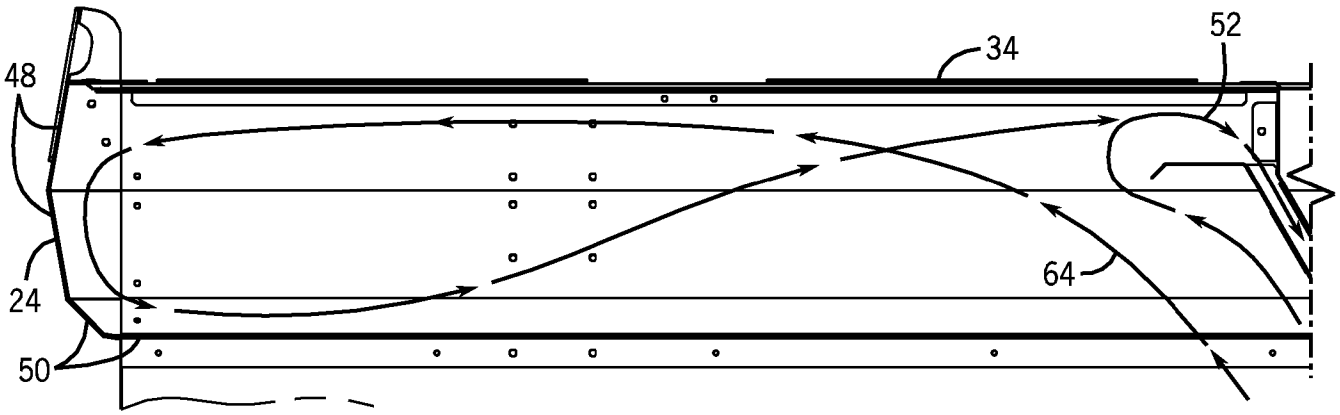
FIG. 6 is a sectional view through the hood structure illustrating a secondary path for gases that are re-circulated within the hood for joining the primary path illustrated in FIG. 5.

It is also contemplated that some of the rising gases may not be directly drawn into the primary path, but may escape sideways toward the side and end rails. FIG. 6 illustrates a secondary path 64 for gases that may be directed back toward the primary path. In particular, such gases will typically rise due to their thermal buoyancy, and impact the cover 34, being directed therefrom to the side panels 48 of the end and side rails. The lower re-directing panels 50 then channel the gases back toward the center of the hood, or more generally toward the one or more extractor rails that are provided for drawing the gases away. At least some of the particulate matter may dropout of this secondary path as it is directed from the top to the sides and back toward the extractor rail. As the second path joins the first path, then, additional particulate matter may be encouraged to drop from the gases as described above.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A fume extractor hood comprising:

a box-like structure having end rails, side rails and a cover, the box-like structure configured to at least partially enclose a volume over a process that generates fumes and particulate matter during operation; and an extractor rail structure disposed in the volume and configured to draw fumes and particulate towards an inner space from which the fumes are conveyed to exhaust ductwork, the extractor rail structure comprising a side wall forcing a first turn of more than 90 degrees in all fumes drawn into the extractor rail structure to force dropout of at least some of the particulate matter, first and second lateral extensions extending outwardly from first and second sides of the side wall, forcing the fumes around the first and second lateral extensions into an inner passageway between the side wall and a deflector that accelerates the fumes entering the extractor rail structure, a base plate coupled to the deflector that in operation forces dropout of at least some of the particulate matter, a dropout tray below the base plate that in operation collects dropped out particulate matter, and gas entries forcing a second turn of more than 90 degrees in all fumes drawn into the extractor rail structure to force dropout of particulate matter entrained with the fumes into the inner passageway, wherein the fumes are forced to enter the extractor rail structure only through a passageway wherein the dropout tray is disposed below the inner passageway, beneath the base plate, for collecting particulate matter dropping out of the fumes due to the second turn, wherein the side wall comprises part of the dropout tray, and between the deflector and the base plate, and therefrom directly into the exhaust ductwork.

2. The hood of claim 1, wherein the first and second lateral extensions extend horizontally.

3. The hood of claim 1, wherein the dropout tray is removable for cleaning.

4. The hood of claim 1, wherein the gas entries comprise apertures in fluid communication with the inner passageway.

5. The hood of claim 4, wherein the apertures comprise slots formed in a lower portion of the side wall.

6. The hood of claim 1, wherein the extractor rail structure is bilaterally symmetrical, comprising symmetric inner passageways, side walls, deflectors, and gas entries.

7. The hood of claim 1, wherein the extractor rail structure is disposed at an approximate centerline of the box-like structure.

8. The hood of claim 1, wherein at least one of the side and end rails comprises a re-directing shape that re-directs fumes not directly entering the extractor rail structure downwardly and back towards the extractor rail structure.

9. A fume extractor hood comprising:

a box-like structure having end rails, side rails and a cover, the box-like structure configured to at least partially enclose a volume over a process that generates fumes and particulate matter during operation; and an extractor rail structure disposed in the volume and configured to draw fumes and particulate towards an inner space from which the fumes are conveyed to exhaust ductwork, the extractor rail structure comprising parallel first and second panels that force at least one first turn of more than 90 degrees in all fumes drawn into the extractor rail structure to force dropout of at least some of the particulate matter outside the extractor rail structure, a first lateral extension extending outwardly from the first panel, forcing the fumes around the first lateral extension, a base plate coupled to a deflector that in operation forces dropout of at least some of the particulate matter, a dropout tray below the base plate that in operation collects dropped out particulate matter, and at least one gas entry that forces at least one second turn of more than 90 degrees in all fumes drawn into the extractor rail structure to force dropout of particulate matter entrained with the fumes to a collection location within the extractor rail structure, wherein the dropout tray is disposed at the collection location, and beneath the base plate, collecting particulate matter dropping out of the fumes due to the second turn, wherein a side wall that contributes to the first and second turns comprises part of the dropout tray, and wherein the fumes are forced to enter the extractor rail structure only through a passageway between the deflector and the base plate, and therefrom directly into the exhaust ductwork.

10. The hood of claim 9, wherein the dropout tray is removable for cleaning.

11. The hood of claim 9, wherein the at least one gas entry comprises apertures in fluid communication with an inner passageway between the first and second turns.

12. The hood of claim 11, wherein the apertures comprise slots formed in a lower portion of a side wall.

13. A fume extractor hood comprising:

a box-like structure having end rails, side rails and a cover, the box-like structure configured to at least partially enclose a volume over a process that generates fumes and particulate matter during operation; and an extractor rail structure disposed in the volume and configured to draw fumes and particulate towards an inner space from which the fumes are conveyed to exhaust ductwork;

wherein the extractor rail structure comprises first and second side walls defining a primary fume path, the side walls being configured and disposed to force a plurality of turns of more than 90 degrees in all fumes drawn into the extractor rail structure to force dropout of at least some of the particulate matter outside and inside the extractor rail structure, first and second lateral extensions extending outwardly from first and second side walls, forcing the fumes around the first and second lateral extensions, a base plate coupled to one of the side walls that in operation forces dropout and of at least some of the particulate matter, and a dropout tray below the base plate that in operation collects dropped out particulate matter, wherein the dropout tray is disposed at a collection location, disposed beneath the base plate, collecting particulate matter dropping out of the fumes inside the extractor rail structure, wherein a side wall that contributes to the turns comprises part of the dropout tray, and wherein the fumes are forced to enter the extractor rail structure only through a passageway between one of the side walls and the base plate, and therefrom directly into the exhaust ductwork; and wherein at least one of the side and end rails comprises a re-directing shape that re-directs fumes in a secondary fume path for fumes not directly entering the extractor rail structure downwardly and back towards the extractor rail structure.

* * * * *